US011896087B2

(12) United States Patent
Kirpichnikov et al.

(10) Patent No.: US 11,896,087 B2
(45) Date of Patent: Feb. 13, 2024

(54) ORTHOPEDIC SHOE SOLE OR INSOLE AND SHOE FOR PEOPLE WITH HALLUX VALGUS

(71) Applicants: Alexey Kirpichnikov, Oberhausen (DE); Yury Seregin, Cologne (DE); Viktor Gordieiev, Blevio (IT)

(72) Inventors: Alexey Kirpichnikov, Oberhausen (DE); Yury Seregin, Cologne (DE)

( * ) Notice: Subject to any disclaimer, the term of this patent is extended or adjusted under 35 U.S.C. 154(b) by 18 days.

(21) Appl. No.: 18/014,702

(22) PCT Filed: Jun. 2, 2022

(86) PCT No.: PCT/EP2022/065071

§ 371 (c)(1),
(2) Date: Jan. 5, 2023

(87) PCT Pub. No.: WO2022/258487

PCT Pub. Date: Dec. 15, 2022

(65) Prior Publication Data

US 2023/0284733 A1 Sep. 14, 2023

(30) Foreign Application Priority Data

Jun. 10, 2021 (IT) ..... 102021000015188

(51) Int. Cl.

| | |
|---|---|
| ***A43B 7/145*** | (2022.01) |
| ***A43B 13/20*** | (2006.01) |
| ***A43B 17/06*** | (2006.01) |

(52) U.S. Cl.
CPC ..... *A43B 7/145* (2013.01); *A43B 13/203* (2013.01); *A43B 17/06* (2013.01)

(58) Field of Classification Search
CPC ..... A43B 7/1425; A43B 7/145; A43B 7/26; A43B 13/203; A43B 17/06
See application file for complete search history.

(56) References Cited

U.S. PATENT DOCUMENTS

| | | | | |
|---|---|---|---|---|
| 2018/0249782 | A1 | 9/2018 | Coquet | |
| 2019/0365026 | A1* | 12/2019 | Clough | A43B 7/149 |
| 2021/0361462 | A1* | 11/2021 | Liu | A61F 5/01 |
| 2022/0142294 | A1* | 5/2022 | Bär | A43B 3/101 |

FOREIGN PATENT DOCUMENTS

| | | | |
|---|---|---|---|
| GB | 2536889 | A | 10/2016 |

OTHER PUBLICATIONS

International Search Report for corresponding PCT application (with English translation), filed Jan. 5, 2023.

* cited by examiner

*Primary Examiner* — Ted Kavanaugh
(74) *Attorney, Agent, or Firm* — Dentons Cohen & Grigsby P.C.

(57) ABSTRACT

A sole or insole for an orthopedic shoe for persons with hallux valgus. The sole or insole includes a main part located at least under and supporting the Digitis Pedis II to V and the ball of the foot, and an element movably connected to the main part that is located under and supports the Digitis Pedis I. The main part of the sole or insole includes a cavity under the Digitis Pedis II to V and/or the transverse arch of the foot that contains a hydraulic, mechanical, pneumatic, electric or other device that causes rotary movement of the moveable element in the horizontal plane laterally away from the main part during a walking movement, in particular caused by the compressive force caused by the wearer's own weight on the sole or insole.

20 Claims, 5 Drawing Sheets

Sectional view

Sectional view

FIG. 2D (enlarged)

ORTHOPEDIC SHOE SOLE OR INSOLE AND SHOE FOR PEOPLE WITH HALLUX VALGUS

CROSS-REFERENCE TO RELATED APPLICATIONS

The present application is a 371 national stage filing of PCT/EP2022/065071, filed Jun. 2, 2022, which claims the benefit of IT202100015188A, filed Jun. 10, 2021.

TECHNICAL FIELD

The invention relates to an orthopedic shoe sole or insole for persons with hallux valgus, wherein the orthopedic shoe sole or insole supports at least the Digitis Pedis I to V and the ball of the foot when walking or in a static state, in particular the entire foot from the Digitis Pedis I to V to the heel. The invention further relates to a shoe having an orthopedic shoe sole or insole.

BACKGROUND

Hallux valgus (bunion of the big toe) is the name given to a crooked position of the Digitis Pedis I (big toe), in which the Digitis Pedis I extends valgusly, i.e., from the center of the body in the direction of the Digitis Pedis II to V. This is called hallux valgus. The direction of pull of the tendons in the foot changes and increases the displacement of the Digitis Pedis I. At the same time, the first metatarsal bone deviates inward with its head, resulting in the typical bunion. In addition to cosmetic problems, hallux valgus can lead to painful pressure points, skin irritation, swelling or inflammation, for example, due to friction of the protruding bunion on the footwear. Consequential damage may include arthrosis or overloading of the neighboring joints of the Digitis Pedis II to V or the metatarsal bones. This malpositioning of the Digitis Pedis I often results from hereditary predisposition and is usually aggravated by wearing tight shoes or shoes with high heels.

Up to a certain stage, hallux valgus can be treated conservatively, as non-surgical, for example by foot gymnastics or wearing foot splints. Foot gymnastics for the treatment of hallux valgus includes exercises that promote the free movement of Digitis Pedis I in all directions. Preferably, foot exercises are performed by a physical therapist and consist of the physical therapist spreading the patient's Digitis Pedis I and returning it to its original position. This spreading movement of the Digitis Pedis I is performed simultaneously in the vertical plane of its natural bending (a movement that also occurs during walking) and in the horizontal plane sideways away from the Digitis Pedis II to V. The patient's Digitis Pedis I is then moved back to its original position. This alleviates the symptoms of hallux valgus in particular, but correction of the deformity is not usually achieved through foot gymnastics. At the same time, flat shoes should be worn in everyday life, which have sufficient clearance, especially in the area of Digitis Pedis I to V and, if necessary, in the area of the big toe joint. Furthermore, insoles can be worn to support the arch of the foot in order to stop the progression of the splayfoot. Furthermore, toe spreaders, toe pads, insoles for support, bunion rollers and hallux splints (orthoses) are known for the treatment of hallux valgus.

Based on this prior art, the invention is based on the task of providing an orthopedic shoe sole or insole for the treatment of hallux valgus, which enables a patient to perform a foot exercise for the treatment of hallux valgus at any time and as often as desired.

SUMMARY

The problem is solved according to the invention by an orthopedic shoe sole or insole for persons with a hallux valgus, wherein the orthopedic shoe sole or insole supports at least the Digitis Pedis I to V and the ball of the foot during walking or in a static state, in particular the entire foot from the Digitis Pedis I to V to the heel, which is characterized in that the orthopedic shoe sole or insole comprises a main part and an element movably connected thereto, the movable element being located under and supporting the Digitis Pedis I and the main part being located at least under and supporting the Digitis Pedis II to V and the ball of the foot, the movable element being movably connected to the main part so as to rotate about an axis in a horizontal plane within the limits of the joint of the Digitis Pedis I and the foot.

The orthopedic shoe sole or insole according to the invention comprises a main part which serves to support the Digitis Pedis II to V and at least the transverse arch of the foot, preferably additionally the longitudinal arch and the heel. The movable element serves to support the Digitis Pedis I and is movably attached to or firmly connected to the main part in the area of the big toe joint (if necessary, as a separate element). This allows the movable element to move in a horizontal plane relative to the main part, in particular to rotate about an axis within the limits of the joint of the Digitis Pedis I and the ball of the foot. The movement of the movable element relative to the main part is limited by suitable means.

The relative movement, in particular the rotational movement in the horizontal direction, between the movable element and the main part of the orthopedic shoe sole or insole preferably occurs during a walking movement of the patient, in particular caused by the compressive force exerted by the patient's own weight on the orthopedic shoe sole or insole. As a result, the orthopedic shoe sole or insole according to the invention periodically generates the movement known from foot gymnastics for mobilizing the Digitis Pedis I and the big toe joint when the patient walks, so that the patient can independently perform the curative foot gymnastics by walking every day. Thus, the movable element preferably moves in the horizontal plane relative to the main part depending on the load of the supported foot, in particular in the form of a pendulum movement whose axis of rotation is located in the area of the big toe joint.

The orthopedic shoe sole or insole according to the invention enables a patient with hallux valgus to independently perform curative foot exercises at any time, especially on a daily basis, thereby minimizing the cost of hallux valgus treatment. The simultaneous movement of the Digitis Pedis I in the vertical and horizontal directions during the performed walking movement mobilizes the Digitis Pedis I and the big toe joint.

According to the invention, there is a cavity in the main part of the shoe sole or insole under the Digitis Pedis II to V and/or the transverse arch of the foot, in which a hydraulic, mechanical, pneumatic, electric or other device is incorporated, which is connected to the movable element and causes the rotational movement in the horizontal plane laterally away from the main part during a walking movement, in particular caused by the compressive force caused by the patient's own weight on the orthopedic shoe sole or insole. The cavity in the main part can also be formed between the insole and the shoe sole. Thus, the orthopedic shoe sole or insole according to the invention generally comprises mechanical, hydraulic, pneumatic, electric or other means to perform the relative movement between the movable element and the main part, in particular during the walking movement of the patient. For example, this is done by loading the transverse arch and/or Digitis Pedis I to V with the patient's own weight, thereby actuating the hydraulic, mechanical, pneumatic, electric or other device.

In an expedient variant of the invention, the device for effecting the rotational movement is a hydraulic device which is in the form of an elastic sheath filled with a gel or other fluid and having a plunger at the end, the plunger being connected to the movable element and being periodically actuated by the pressure exerted by the foot on the sheath at the beginning of each step. During the walking movement, the patient exerts a force by his own weight on the sheath filled with the gel or other liquid, which moves the plunger and thus the movable element connected to it relative to the main part. If the pressure on the sheath is released, the plunger and the associated movable element can return to their original position.

According to an alternative variant of the invention, the device for effecting the rotary motion is a pneumatic device, which is in the form of an elastic sheath filled with air or other gas, with a plunger at the end, the plunger being connected to the movable element and being periodically actuated by the pressure exerted by the foot on the sheath at the beginning of each step. The pneumatic variant differs from the hydraulic variant mainly in the medium used to move the plunger.

According to a further variant of the invention, the device for effecting the rotary movement is a mechanical device which is in the form of a leaf spring which is connected at a first end in the cavity to the main part and at a second end to the movable element, the leaf spring being periodically actuated by the pressure exerted by the foot on the leaf spring at the beginning of each step. This variant is particularly simple and inexpensive to manufacture and is less prone to failure, since it does not require a liquid or gaseous medium which may escape if the orthopedic shoe sole or insole according to the invention is damaged.

In another variant according to the invention, the movable element is connected to the main part of the shoe sole or insole by means of a plate which allows the movable element to be locked away to the side with respect to the main part of the sole at different spreading angles. In general, the orthopedic shoe sole or insole according to the invention comprises means, in particular mechanical means, for fixing the movable element relative to the main part in different positions, independently of the load on the supported foot. The Digitis Pedis I is thus fixed by the fixed movable element at a certain distance from the Digitis Pedis II supported on the main part, whereby a vertical movement is generated by the walking movement (bending of the foot), which also generates a remedial gymnastic movement that can be regularly adjusted by a physiotherapist, for example, due to the different adjustable positions. This is particularly advantageous if a simultaneous horizontal and vertical movement is too painful for the patient.

According to a further advantageous variant of the invention, the movable element comprises a fixation for the Digitis Pedis I so that it is guided at all times during the horizontal rotational movement generated. The fixation is, for example, one or more elevations on the movable element or formed as a loop or the like.

The problem is further solved by a shoe comprising an orthopedic shoe sole or insole according to the invention. Expediently, the shoe is designed as a shoe open at the front, since this simplifies the relative movement between the main part and the movable element.

In an expedient variant, the sole of a shoe according to the invention additionally comprises a base plate on which the movable element can be moved. The base plate is preferably connected to the main part and formed integrally therewith. The base plate prevents direct contact between the ground and the movable element, so that the movement of the movable element is not hindered by friction with the ground.

BRIEF DESCRIPTION OF THE DRAWINGS

The invention is explained in more detail below with reference to examples of embodiments shown in the accompanying figures. They show:

FIGS. 2A-2E illustrate different views of a shoe with a second embodiment of an orthopedic shoe sole according to the invention.

DETAILED DESCRIPTION

Figure 1A:
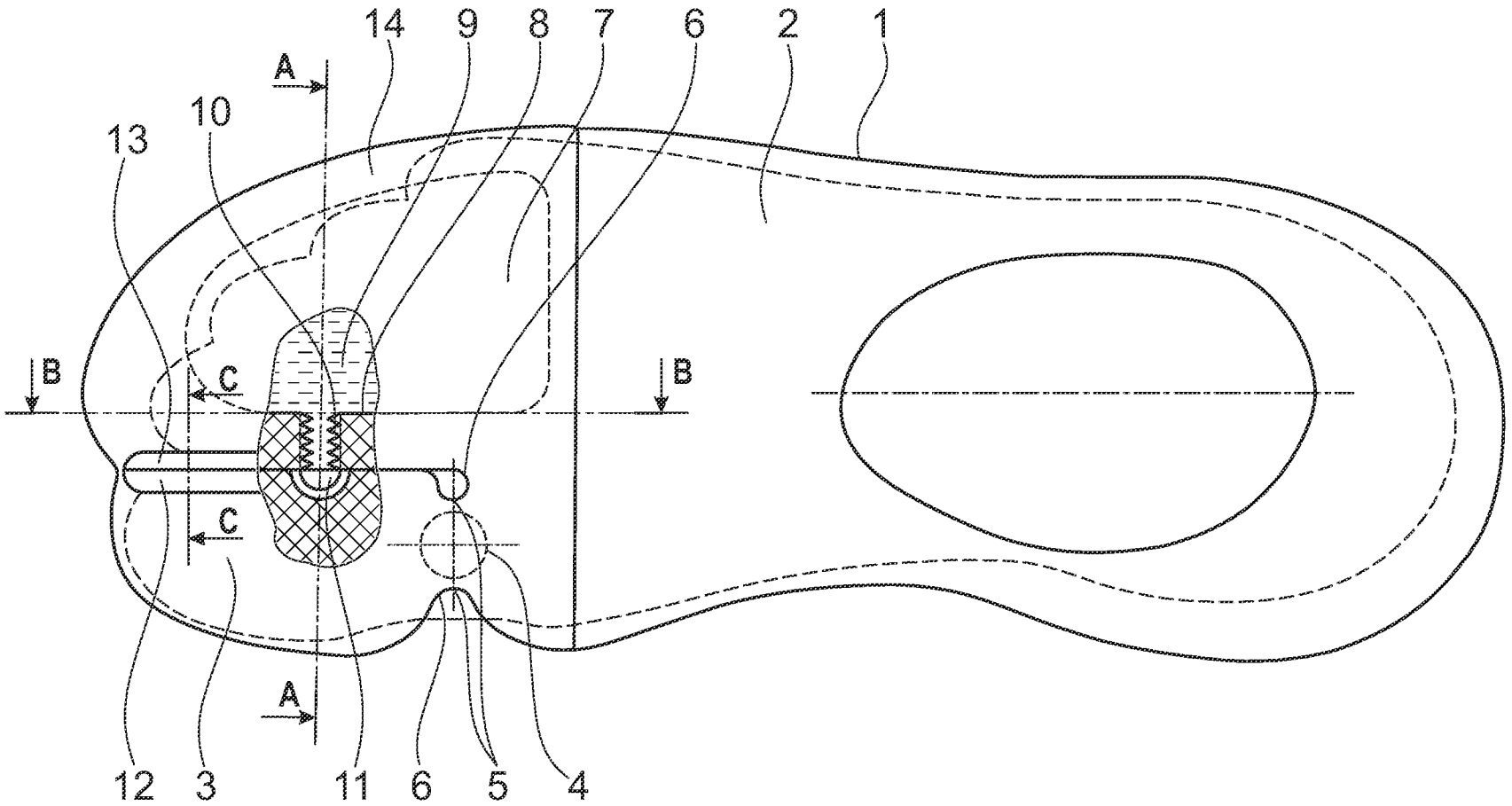
FIGS. 1A-1D illustrate different views of a shoe with a first embodiment of an orthopedic shoe sole according to the invention.

FIG. 1A shows a top view of a right shoe with an orthopedic shoe sole 1 according to the present invention, for persons with hallux valgus. The orthopedic shoe sole 1 according to the first embodiment of FIG. 1A supports the entire foot from Digitis Pedis I to V to the heel when walking or in a static state. The shoe of FIG. 1A comprises the orthopedic insole 1 according to the invention and an upper part 2, which preferably consists of an elastic material. Furthermore, the shoe is expediently open at the front to allow relative movement between the Digitis Pedis I and the Digitis Pedis II to V as described below. Alternatively, the shoe could have a corresponding free space for the relative movement.

The foot of the wearer of the shoe is represented by a dashed line in FIG. 1A.

The orthopedic shoe sole 1 of the shoe of FIG. 1A comprises a main part 14 and an element 3 movably connected thereto. The movable element 3 is located under and supports the Digitis Pedis I, while the main part 14 is located at least under and supports the Digitis Pedis II to V and the ball of the foot. According to the first embodiment example of FIG. 1A, the main part 14 supports the foot in the area of the Digitis Pedis II to V up to the heel.

The movable element 3 is movably connected to the main part 14 via the connection 5. The relative movement between the movable element 3 and the main part 14 is ensured, for example, by the elasticity of the material used and can be supported by the indentations in the form of roundings 6. In particular, the roundings 6 prevent cracking due to stretching processes caused by the relative movement between the movable element 3 and the main part 14. The connection 5 between the movable element 5 and the main part 14 may be formed in one piece, so that both are made from the same basic piece, or a subsequently manufactured connection 5, so that both are manufactured separately and subsequently connected.

The connection 5 between the movable element 3 and the main part 14 is designed in such a way that the movable element 3 can rotate about an axis 5 in a horizontal plane within the limits of the joint of the Digitis Pedis I and the ball of the foot. The axis of rotation 5 is preferably located in the area of the joint of the Digitis Pedis I (big toe joint).

Figure 1B:
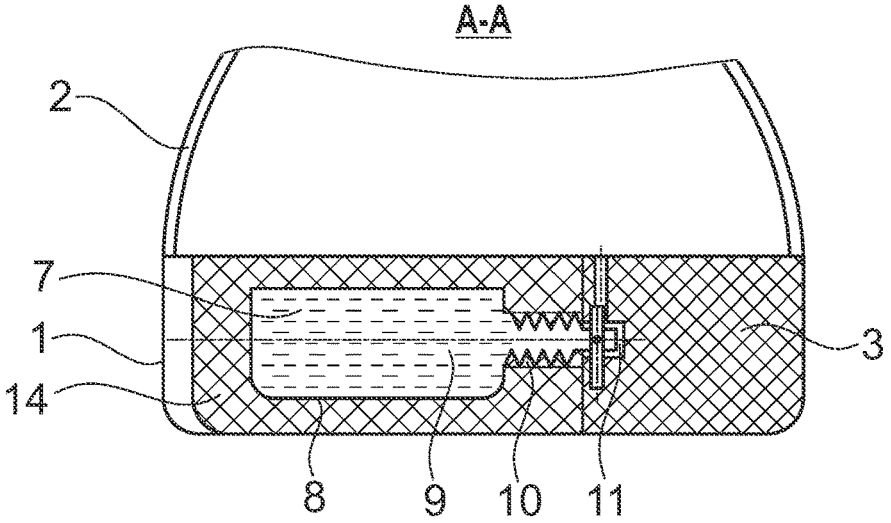
Figure 1C:
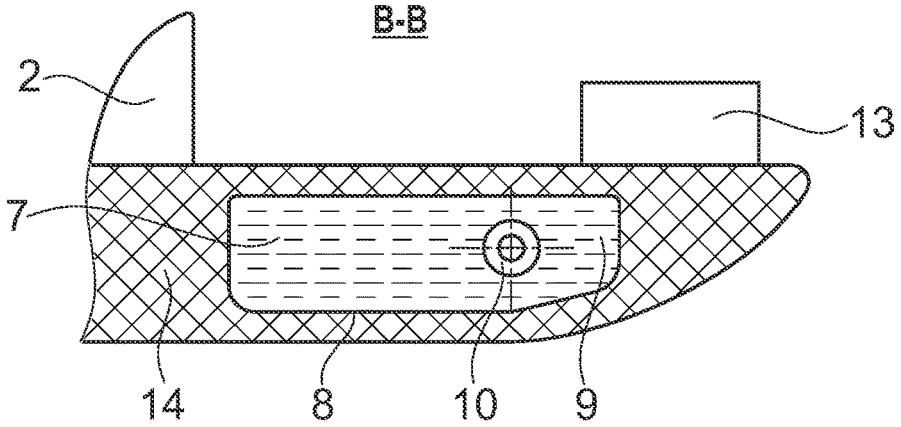
Figure 1D:
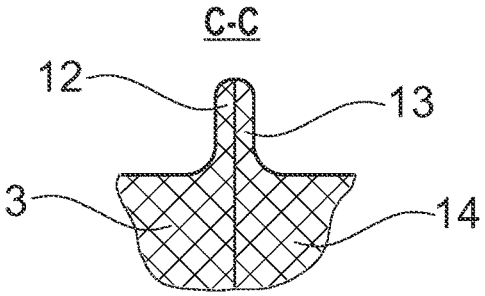

FIGS. 1B and 1C show sectional views along lines A-A and B-B, respectively, of FIG. 1A. As can be seen in particular from FIGS. 1B and 1C, a cavity 7 is located in the front area of the main part 14 of the shoe sole 1, in particular under the Digitis Pedis II to V. According to the first embodiment example of FIG. 1B, a hydraulic device is installed in this cavity, which is connected to the movable element 3 and causes the rotational movement in the horizontal plane laterally away from the main part 14 during a walking movement, in particular caused by the compressive force caused by the patient's own weight on the orthopedic shoe sole 1.

The hydraulic device comprises, for example, an elastic sheath 8 in the cavity 7. This sheath 8 is filled with a gel or other fluid 9. On the side adjacent to the end face of the movable element 3, the sheath 8 comprises a plunger 10. This plunger 10 is designed, for example, as a corrugated tube, the tube profile being in particular in the form of a thread. In this case, the plunger 10, in particular the corrugated tube, is made of a material which has a higher strength than the elastic sheath 8. The closed end piece 11 of the plunger 10 is connected to the movable element 3. The hydraulic device thus formed is periodically actuated by the pressure exerted by the foot at the beginning of each step, in particular a pressure is exerted on the elastic sheath 8, causing the plunger 10 to move the movable element 3 relative to the main part 14 and causing the rotary movement in the horizontal plane laterally away from the main part 14.

A compression spring can be inserted into the plunger 10, in particular the corrugated tube, in order to adapt the mechanical properties of the hydraulic device, in particular to generate a preload. This allows the pressure required to generate the relative movement between the movable element 3 and the main part 14 to be adapted to the individual needs of a patient.

It is expedient to have an elevation 12 on the side of the movable element 3 facing the Digitis Pedis II, which ensures that the Digitis Pedis I can be moved with the movable element 3. Accordingly, the main part 14 can have an elevation 13 on the side towards the Digitis Pedis I, which fixes the Digitis Pedis II and thereby also the Digitis Pedis III to V on the main part 14. The elevation 12 of the movable element 3 and the elevation 13 of the main part 14 are shown in detail in FIG. 1C. Instead of the elevation 12 and/or the elevation 13, a bracket, a loop or the like can also be used to fix the Digitis Pedis I on the movable element 3 or at least the Digitis Pedis II on the main part 14.

When walking, the heel of the foot lifts and the toe of the foot comes into a horizontal position and the entire weight of the person presses on the elastic sheath 8. The plunger 10 expands and spreads the movable element 3 to the side. The elevation 12 on the movable element 3 ensures that the Digitis Pedis I moves together with the movable element 3. During each step, the Digitis Pedis I thus simultaneously performs a movement in two planes, namely in the vertical plane together with the other Digitis Pedis II to V and a sideways splaying/pendulum movement in the horizontal plane together with the movable element 3 away from the Digitis Pedis II to V. When the compressive force is no longer applied, the movable element 3 and the Digitis Pedis I return to their initial position.

If the person remains standing on the tips of the feet, the pressure is permanently applied to the hydraulic device and the movable element 3 spreads the Digitis Pedis I correspondingly from the Digitis Pedis II to V during this time, which also corresponds to a remedial gymnastic exercise for hallux valgus patients.

The specific method of use, the frequency and amplitude of relative movement of the movable element 3 are specified by physician, especially orthopedists.

Figure 2A:
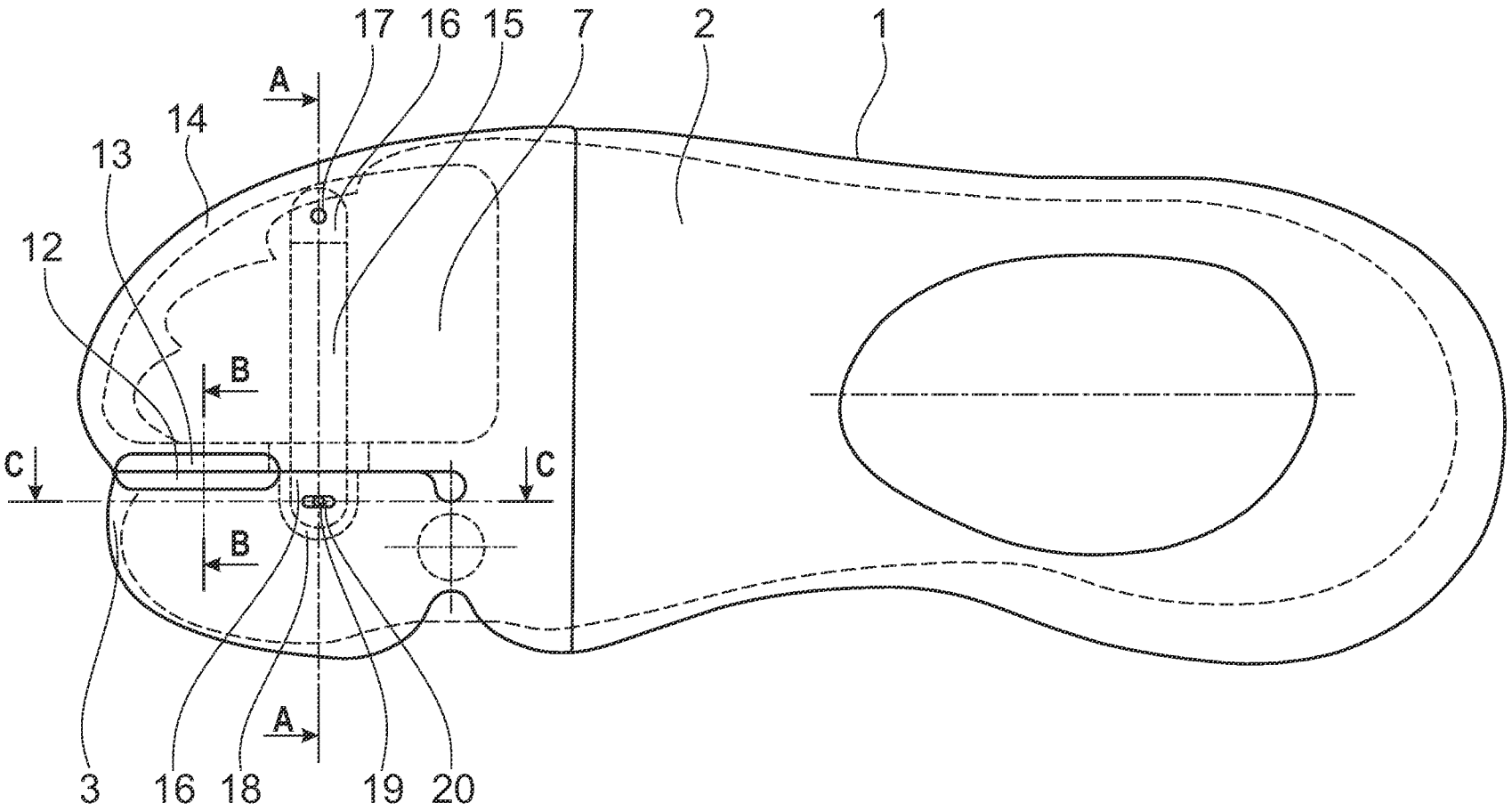

FIG. 2A shows various views of a shoe according to a second embodiment of an orthopedic shoe sole 1 according to the invention. The second embodiment of FIG. 2A differs from the first embodiment of FIG. 1A in that there is no hydraulic device installed in the cavity 7, which is connected to the movable element 3 and causes the rotational movement in the horizontal plane laterally away from the main part 14 during a walking movement, but a mechanical device which is connected to the movable element 3 and causes the rotational movement in the horizontal plane laterally away from the main part 14 during a walking movement.

The mechanical device according to the second embodiment of FIG. 2A comprises a leaf spring 15 having end portions 16. The leaf spring 15 is connected with the right end section 16 to the main part 14 of the shoe sole 1 via the connecting element 17. At the joint between the main part 14 and the movable element 3, the leaf spring 15 is inserted in a groove 18 of the movable element 3 and is connected to the movable element 3 by the axis 19. The leaf spring 15 has an elongated hole 20 for the axis 19 in the end portion 16 which is connected to the movable element 3, so that the offset of the axis 19 which occurs during the swinging/pendulum movement of the movable member 3 can be compensated. Details of this can be seen in particular in FIGS. 2D and 2E, which show sectional views along the lines C-C and D-D, respectively, of FIG. 2A.

Figure 2B:
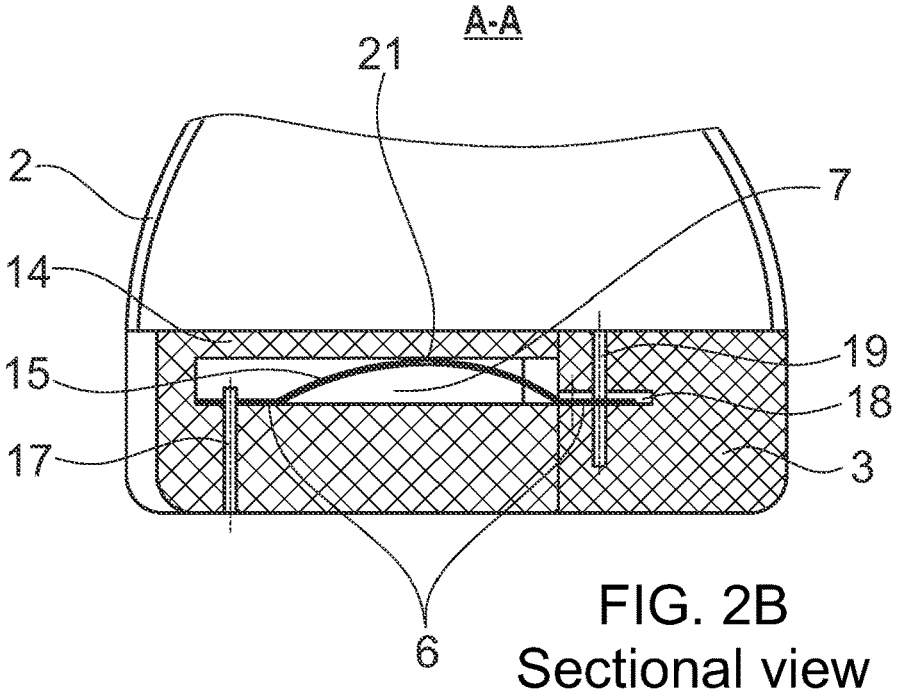
Figure 2C:
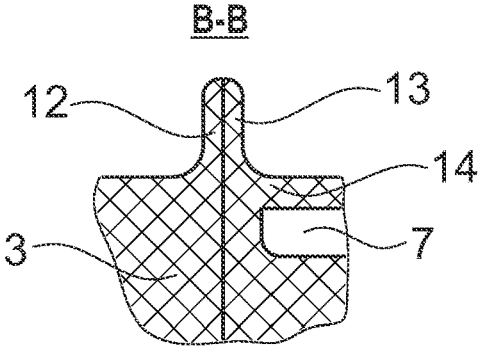
Figure 2E:
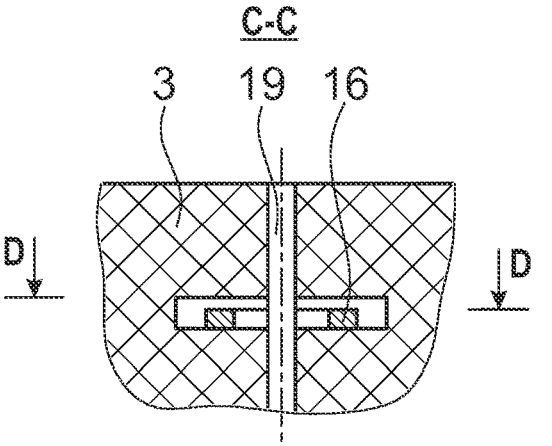
Figure 2E:
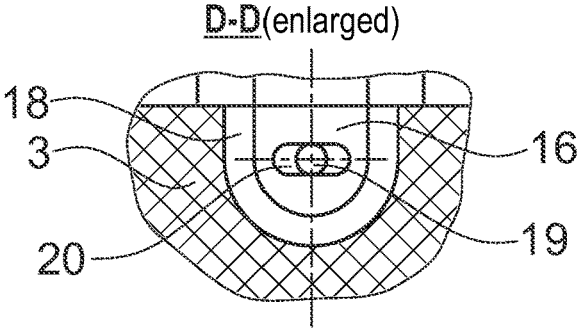

The leaf spring 15 has an upwardly curved region 21, as can be seen in particular from the sectional view of FIG. 2B, where FIG. 2B shows a sectional view along the line A-A of FIG. 2A. The upwardly curved region 21 of the leaf spring 15 presses from below against the upper plane of the cavity 7, as shown in FIG. 2B.

On the movable element 3 there is an elevation 12 and on the main part 14 there is an elevation 13, corresponding to the first embodiment example of FIG. 1A, which fix the Digitis Pedis I or the Digitis Pedis II to V during the relative movement between the movable element 3 and the main part 14.

Figure 3A:
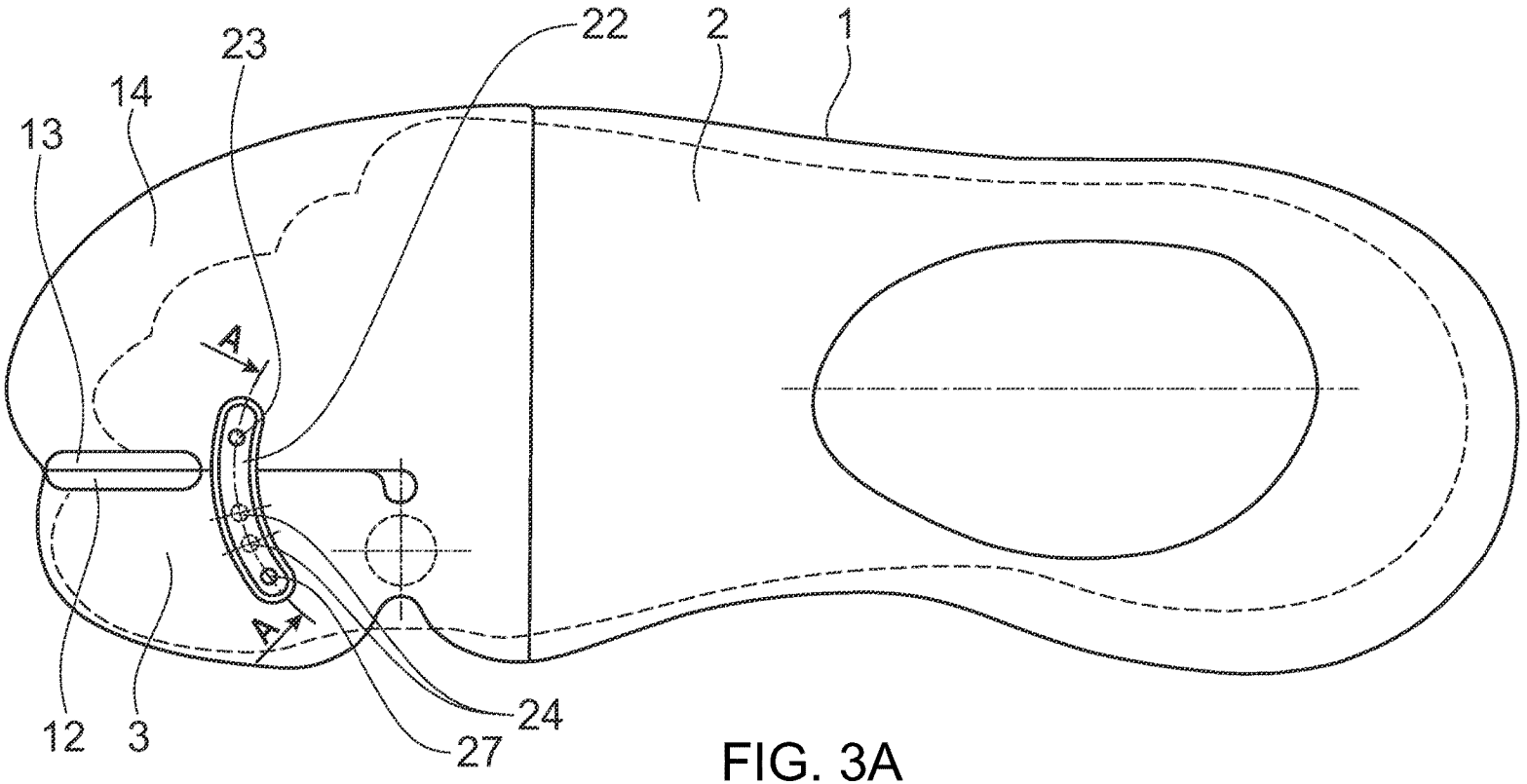
FIGS. 3A and 3B illustrate different views of a shoe with a third embodiment of a shoe sole according to the invention.

FIG. 3A shows various views of a shoe with a third embodiment of a shoe sole 1 according to the invention. FIG. 3A shows a top view of a right shoe with the orthopedic shoe sole 1 according to the present invention, for persons with hallux valgus. The orthopedic shoe sole 1 according to the third embodiment of FIG. 3A supports the entire foot from Digitis Pedis I to V to the heel when walking or in a static state. The shoe of FIG. 3A comprises the orthopedic insole 1 according to the invention and a top 2, which is preferably made of an elastic material. Furthermore, the shoe is expediently designed to be open at the front in order to flexibly adjust the distance between the Digitis Pedis I and the Digitis Pedis II to V as described below. Alternatively, the shoe could have a corresponding free space for the adjustment.

The foot of the wearer of the shoe is represented by a dashed line in FIG. 3A.

The orthopedic shoe sole 1 of the shoe of FIG. 3A comprises a main part 14 and an element 3 movably connected thereto. The movable element 3 is located under and supports the Digitis Pedis I, while the main part 14 is located at least under and supports the Digitis Pedis II to V and the ball of the foot. According to the third embodiment example of FIG. 3A, the main part 14 supports the foot in the area of the Digitis Pedis II to V up to the heel.

The movable element 3 is movably connected to the main part 14 via the connection 5. The relative movement between the movable element 3 and the main part 14 is ensured, for example, by the elasticity of the material used and can be supported by the indentations in the form of roundings 6. In particular, the roundings 6 prevent cracking due to stretching processes caused by the relative movement between the movable element 3 and the main part 14. The connection 5 between the movable element 3 and the main part 14 may be formed in one piece, so that both are made from the same basic piece, or a subsequently manufactured connection 5, so that both are manufactured separately and subsequently connected.

The connection 5 between the movable element 3 and the main part 14 is designed in such a way that the movable element 3 can rotate about an axis 4 in a horizontal plane within the limits of the joint of the Digitis Pedis I and the ball of the foot. The axis of rotation 4 is preferably located in the area of the joint of the Digitis Pedis I (big toe joint).

Figure 3B:
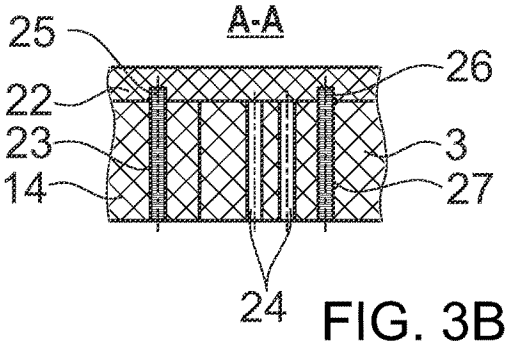

In contrast to the first embodiment of FIG. 1A and the second embodiment of FIG. 2A, in the third embodiment of FIG. 3A, the movable element 3 is connected to the main part 14 of the sole 1 of the shoe via a plate 22, which allows the movable element 3 to be locked away to the side with respect to the main part 14 of the sole 1 at different spreading angles, as shown for example in detail in FIG. 3B.

The plate 22 is connected to the main part 14 at one end via a first pin 23. The first pin 23 is locked, for example screwed, from below through an opening in the main part 14 of the soleplate 1 into a first bulge 25 of the plate 22. At the other end, in the region of the movable element 3, the plate 22 has a second bulge 26 for a second pin 27. The movable member 3 of the sole 1 has a plurality of openings 24 for the second pin 27, so that the second pin 27 can be passed through one of the openings 24 and locked in the second bulge 26. The distance between the main part 14 and the movable element 3 is thereby adjusted by the choice of the opening 24 through which the second pin 27 is locked in the second bulge 26.

The Digitis Pedis I is thus fixed by the fixed movable element 3 at a certain distance from the Digitis Pedis II supported on the main part 14, whereby a vertical movement is generated by the walking movement (bending of the foot), which also generates a remedial gymnastic movement that can be regularly adjusted by a physiotherapist, for example, due to the different adjustable positions. This is particularly advantageous if a simultaneous horizontal and vertical movement is too painful for the patient.

LIST OF REFERENCE SIGNS

1 shoe sole
2 top
3 movable element
4 axis of rotation (limits of the joint Digitis Pedis I)
5 fixing/connection movable element
6 roundings
7 cavity
8 elastic sheath
9 liquid
10 plunger
11 end piece (plunger)
12 elevation (movable element)
13 elevation (main part)
14 main part
15 leaf spring
16 end sections of leaf spring
17 fastening element
18 groove (movable element)
19 axis
20 long hole (leaf spring)
21 curved area leaf spring
22 plate
23 first pin
24 openings
25 first bulge
26 second bulge
27 second pin

The invention claimed is:

1. An orthopedic shoe sole or insole for persons with hallux valgus, wherein the orthopedic shoe sole or insole supports at least the Digitis Pedis I to V and the ball of the foot when walking or in a static state, wherein the orthopedic shoe sole or insole comprises:

a main part a moveable element connected thereto, the movable element configured to be located under and supporting the Digitis Pedis I of a foot and the main part configured to be located at least under and supporting the Digitis Pedis II to V and the ball of the foot, wherein the movable element is movably connected to the main part so as to rotate about an axis in a horizontal plane within limits of the joint of the Digitis Pedis I and the ball of the foot, a cavity in the main part of the shoe sole or insole configured to be under the Digitis Pedis II to V, the transverse arch of the foot, or both, a device installed within the cavity and connected to the movable element, wherein the device is configured to cause the rotary movement in the horizontal plane laterally away from the main part during a walking movement, wherein the device is a hydraulic, pneumatic, or mechanical device.

2. The orthopedic shoe sole or insole according to claim 1, wherein the device installed within the cavity for effecting the rotary motion is a hydraulic device.

3. The orthopedic shoe sole or insole of claim 2, wherein the hydraulic device comprises an elastic sheath filled with a gel or other fluid and having a plunger at the end, the plunger being connected to the movable element and being actuated by the pressure force on the sheath at a beginning of each step.

4. The orthopedic shoe sole or insole according to claim 1, wherein the device installed within the cavity for effecting the rotary motion is a pneumatic device.

5. The orthopedic shoe sole or insole of claim 4, wherein the pneumatic device comprises an elastic sheath filled with air or other gas and having a plunger at the end, the plunger being connected to the movable element and being actuated by the pressure force on the sheath at a beginning of each step.

6. The orthopedic shoe sole or insole according to claim 1, wherein the device installed within the cavity for effecting the rotary movement is a mechanical device.

7. The orthopedic shoe sole or insole of claim 6, wherein the mechanical device comprises a leaf spring having a first end connected in the cavity of the main part and a second end connected to the movable element, the leaf spring being actuated by the pressure force on the leaf spring at a beginning of each step.

8. The orthopedic shoe sole or insole according to claim 1, wherein the movable element is connected to the main part of the shoe sole or insole via a plate configured to allow the movable element to be locked away to the side with respect to the main part of the sole at different spreading angles.

9. A shoe comprising an orthopedic shoe sole or insole according to claim 1.

10. The orthopedic shoe sole or insole of claim 1, wherein the sole or insole supports the foot from the Digitis Pedis I to V to the heel.

11. The orthopedic shoe sole or insole according to claim 1, wherein the rotary movement in the horizontal plane laterally away from the main part caused by the device installed within the cavity is brought about by pressure force of a wearer's weight on the orthopedic shoe sole or insole during the walking movement.

12. A sole or insole for an orthopedic shoe that supports a foot from Digitis Pedis I to V to heel, the sole comprising:

a main part configured to be located under and supporting the Digitis Pedis II to V and the ball of the foot;

a moveable element rotatably connected to the main part and configured to be located under and supporting the Digitis Pedis I of the foot;

a cavity in the main part configured to be under the Digitis Pedis II to V, the transverse arch of the foot, or both; and a device installed within the cavity and connected to the movable element, the device configured to cause rotational movement of the moveable element along a horizontal plane in a direction laterally away from the main part, the rotational movement being within a limit of the joint of the Digitis Pedis I and the ball of the foot, wherein the device is a hydraulic, pneumatic, or mechanical device that is actuated by a pressure force of a wearer's weight on the sole or insole during a walking movement.

13. The shoe or insole according to claim 12, wherein the device installed within the cavity for effecting the rotary motion is a hydraulic device comprising: an elastic sheath filled with a gel or other fluid, and a plunger at an end of the elastic sheath, wherein the plunger is connected to the movable element and is actuated by the pressure force exerted on the sheath at a beginning of each step of the walking movement.

14. The shoe or insole according to claim 12, wherein the device installed within the cavity for effecting the rotary motion is a pneumatic device comprising: an elastic sheath filled with air or other gas, and a plunger at an end of the elastic sheath, wherein the plunger is connected to the movable element and is actuated by the pressure force exerted on the sheath at a beginning of each step of the walking movement.

15. The shoe or insole according to claim 12, wherein the device installed within the cavity for effecting the rotary motion is a mechanical device comprising: a leaf spring having a first end connected in the cavity of the main part and a second end connected to the movable element, wherein the leaf spring is actuated by the pressure force exerted thereon at a beginning of each step of the walking movement.

16. The shoe or insole according to claim 15, wherein the movable element is connected to the main part via a plate configured to allow the movable element to be locked at different spreading angles with respect to the main part.

17. A shoe comprising the sole or insole according to claim 12.

18. A shoe for persons with hallux valgus, the shoe comprising an orthopedic sole that supports a foot from Digitis Pedis I to V to heel, the sole comprising:

a main part configured to be located under and supporting the Digitis Pedis II to V and the ball of the foot;

a moveable element rotatably connected to the main part and configured to be located under and supporting the Digitis Pedis I of the foot;

a cavity in the main part configured to be under the Digitis Pedis II to V, the transverse arch of the foot, or both; and a device installed within the cavity and connected to the movable element, the device configured to cause rotational movement of the moveable element along a horizontal plane in a direction laterally away from the main part, the rotational movement configured to be within a limit of the joint of the Digitis Pedis I and the ball of the foot and brought about by a pressure force of a wearer's weight on the orthopedic sole during a walking movement.

19. The orthopedic shoe of claim 18, wherein the device comprises an elastic sheath filled with a gas or fluid, and a plunger at an end of the sheath, wherein the plunger is connected to the movable element and is actuated by the pressure force on the sheath at a beginning of each step.

20. The orthopedic shoe sole of claim 18, wherein the device comprises a leaf spring having a first end connected in the cavity of the main part and a second end connected to the movable element, wherein the leaf spring is actuated by the pressure force on the leaf spring at a beginning of each step, and wherein the movable element is connected to the main part via a plate configured to allow the movable element to be locked at different spreading angles with respect to the main part.

* * * * *